US006360388B2

(12) United States Patent
Langer

(10) Patent No.: US 6,360,388 B2
(45) Date of Patent: Mar. 26, 2002

(54) SUPPORT PILLOW

(76) Inventor: Victoria A. Langer, 841 W. Debby La., Mansfield, OH (US) 44906

( * ) Notice: Subject to any disclaimer, the term of this patent is extended or adjusted under 35 U.S.C. 154(b) by 0 days.

(21) Appl. No.: 09/790,092

(22) Filed: Feb. 21, 2001

Related U.S. Application Data

(63) Continuation of application No. 09/460,622, filed on Dec. 14, 1999, now abandoned.

(51) Int. Cl.[7] ..... A61G 12/00; A47G 9/00

(52) U.S. Cl. ..... 5/632; 5/636; 5/490; 5/648; 5/699

(58) Field of Search ..... 5/632, 630, 636, 5/655, 490, 740, 699, 736, 655.9, 925, 648; D6/601

(56) References Cited

U.S. PATENT DOCUMENTS

| | | | | | |
|---|---|---|---|---|---|
| 3,974,532 | A | * | 8/1976 | Ecchuya | 5/699 |
| 4,070,719 | A | | 1/1978 | Morgan | |
| 4,620,337 | A | | 11/1986 | Williams et al. | |
| 4,777,855 | A | * | 10/1988 | Cohen | 5/636 |
| 4,916,765 | A | | 4/1990 | Castronovo, Jr. | |
| 5,265,294 | A | * | 11/1993 | McClure et al. | 5/699 |
| 5,371,909 | A | | 12/1994 | McCarty | |
| D368,824 | S | | 4/1996 | Bonaddio et al. | |
| D369,491 | S | | 5/1996 | Bonaddio et al. | |
| D370,819 | S | | 6/1996 | Bonaddio et al. | |
| 5,530,974 | A | | 7/1996 | Rains et al. | |
| 5,533,218 | A | | 7/1996 | Fahy | |
| D373,042 | S | | 8/1996 | Bonaddio et al. | |
| D375,222 | S | | 11/1996 | Bonaddio et al. | |
| D376,502 | S | | 12/1996 | Bonaddio et al. | |
| 5,682,633 | A | | 11/1997 | Davis | |
| D402,494 | S | | 12/1998 | Langer | |
| 5,997,491 | A | * | 12/1999 | Harris | 5/648 |
| 6,067,679 | A | * | 5/2000 | Rice | 5/630 |

OTHER PUBLICATIONS

HFD, Sep. 26, 1988, p. 83, Cannon Royal Family ad.

* cited by examiner

*Primary Examiner*—Alexander Grosz
(74) *Attorney, Agent, or Firm*—Renner, Otto, Boisselle & Sklar, LLP

(57) ABSTRACT

A support pillow for assisting to position a person on their side. The support pillow has a cylindrical foam core and a foam exterior portion wrapped around the circumference of the core. The exterior portion has a plurality of projections extending radially from a longitudinal axis of the support pillow, each projection having a height selected in the range of 3.5 to 8 inches. The core has a higher density and a higher firmness than the exterior portion. The pillow can be coated with a layer of vinyl. The pillow can be part of a support pillow assembly also having a fabric cover, the cover being laminated with a polyurethane film and covering a semi-cylindrical portion of the pillow. Alternative embodiments used to support the lower leg extremities of a person are also presented.

32 Claims, 4 Drawing Sheets

SUPPORT PILLOW

This application is a continuation of U.S. application Ser. No. 09/460,622 filed Dec. 14, 1999 now abandoned.

TECHNICAL FIELD

The present invention generally relates to support pillows and, more particularly, to a pillow for positioning a person.

BACKGROUND ART

There is an ever present demand for devices to support and position patients when they are in a lying position. Traditionally, patients have been supported by ordinary pillows made from a fabric bag filled with feathers, foam granules, a smooth foam core or the like. These pillows have been made in a variety of shapes and sizes. Patients have also been supported by folded blankets. Other supports having a convoluted surface and typically made of foam are also known. Examples of these supports are illustrated in U.S. Pat. Nos. 4,620,337, Des. 368,824, Des. 369,491 and Des. 370,819. However, all of the supports to date suffer from one or more problems. These problems include failing to provide enough support to keep the patient in a secure position or adequately elevate a portion of the patient. These problems are often caused by supports having an inadequate shape and/or firmness. Another common support problem is the failure to have a firmness and/or a surface contour which offers enough pressure relief. If pressure caused by the weight of a bed ridden patient on the patient's soft tissue over bony prominences is not decreased, the patient will develop pressure ulcers and existing ulcers will not heal. Pressure ulcers include any type of tissue necrosis that develops when soft tissue is compressed between a bony prominence and an external surface for a prolonged period of time and are also referred to as decubitus ulcers, diabetic ulcers, dermal ulcers, arterial ulcers, venous ulcers, stasis ulcers, bedsores and pressure sores. The supports to date are not capable of providing sufficient pressure reduction where prominent areas of the patient can sink into the support while also allowing a maximum amount of blood to flow in the area supported by the support.

SUMMARY OF THE INVENTION

The present invention provides a support pillow for assisting to position a person on their side. The support pillow has a foam core and a foam exterior portion wrapped around the circumference of the core. The exterior portion has a plurality of projections extending radially from a longitudinal axis of the support pillow, each projection having a height selected in the range of 3.5 to 8 inches. The core has a higher density and a higher firmness than the exterior portion.

According to another aspect of the invention, the pillow is coated with a layer of vinyl.

According to another aspect of the invention, the pillow is part of a support pillow assembly also having a fabric cover, the cover being laminated with a polyurethane film and covering a semi-cylindrical portion of the pillow.

According to another embodiment of the invention a support pillow assembly for supporting the lower leg extremities of a person is provided. The support pillow assembly has a semi-cylindrical foam core and a foam exterior portion. The exterior portion has a bottom defining a semi-cylindrical notch in which the core is received. The exterior portion has a top defining a plurality of projections extending in a generally upward direction. Each projection has a height selected in the range of 3.5 to 8 inches. The core has a higher density and a higher firmness than the exterior portion.

According to another embodiment of the invention a support pillow assembly for supporting the lower leg extremities of a person is provided. The support pillow assembly has a foam core, the core has a flat bottom side and an arcuate top side. The arc of the top side is defined the locus of a radius where the radius is much larger than a height of the core. The support pillow assembly also has a foam exterior portion, the exterior portion having a bottom secured to the top of the core. The exterior portion has a top, the top defining a plurality of projections extending in a generally upward direction. Each projection has a height selected in the range of 3.5 to 8 inches. The core has a higher density and a higher firmness than the exterior portion.

BRIEF DESCRIPTION OF DRAWINGS

These and further features of the present invention will be apparent with reference to the following description and drawings, wherein.

DISCLOSURE OF INVENTION

Figure 1:
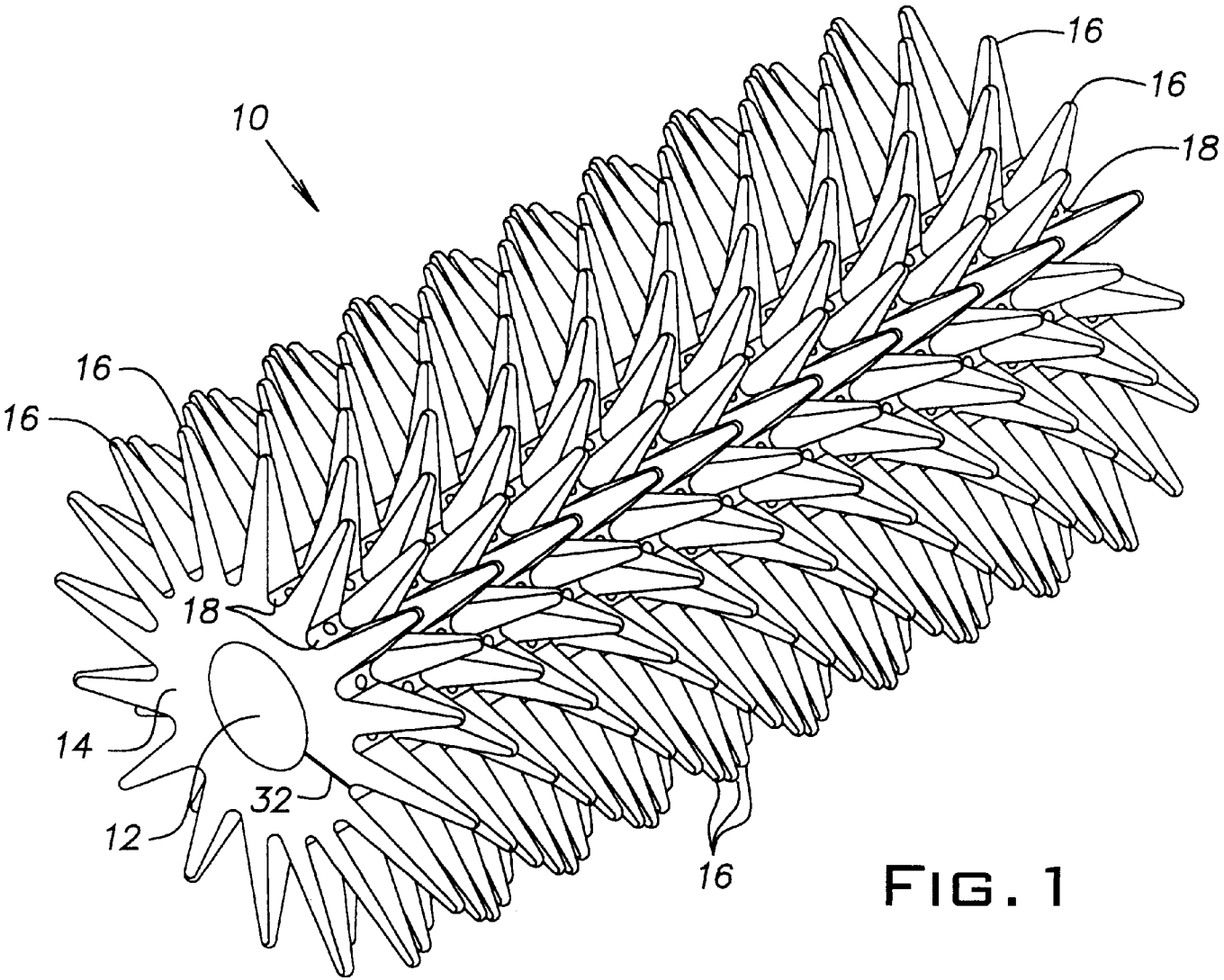
FIG. 1 is an perspective view of a support pillow according to a first embodiment of the present invention.

In the detailed description which follows, identical components have been given the same reference numerals, regardless of whether they are shown in different embodiments of the present invention. In order to clearly and concisely illustrate the present invention, the drawings may not necessarily be to scale and certain features may be shown in somewhat schematic form.

FIG. 1 shows a first embodiment of a support pillow 10 according to the present invention. The support pillow 10 has a generally cylindrical configuration which allows the support pillow 10 to be used as a positioning pillow for a patient with a medical condition that prevents the patient from lying on his or her back. With the patient lying on his or her side the pillow 10 can be placed on the patient's bed in back of the patient and against the patient's spine. As will be discussed in more detail below, the pillow 10 grips the bedding to minimize movement of the pillow 10 relative to the bed and the pillow 10 supports the patient and substantially prevents the patient from rolling onto his or her back. The pillow 10 also reduces pressure placed on the soft tissue of the patient thereby reducing the possibility of the patient developing pressure ulcers.

The pillow 10 is provided with a core 12 and an exterior portion 14, both of which are made from open cell polyurethane foam. The core 12 is generally cylindrical. The term cylindrical should be understood to include a core having a regular or irregular cross-section at every point along the length of the core 12. It also includes a continuous or discontinuous core 12. One skilled in the art will appreciate that the core 12 can alternatively have a non-round cross-sectional shape, such as elliptical, triangular, rectangular or other polygon, with similar results.

The foam of the core 12 has a higher density and a higher firmness than the foam of the exterior portion 14. The density and the firmness of the core 12 and the exterior portion 14 can be changed proportionally to the patient's size and weight. The density of the core 12 in one embodiment is 0.5 to 15 lbs/cu·ft, in one embodiment 0.75 to 5 lbs/cu·ft, and in one embodiment 1.0 to 3 lbs/cu·ft. The firmness measured in terms of initial force deflection (IFD) under ASTM D 3574, also referred to as initial load deflection (ILD), for the core 12 in one embodiment is 15 to 100 lbs, in one embodiment 25 to 85 lbs, and in one embodiment 30 to 70 lbs. The density of the exterior portion 14 in one embodiment is 0.25 to 5.0 lbs/cu·ft, in one embodiment 0.75 to 2.5 lbs/cu·ft, and in one embodiment 0.9 to lbs/cu·ft. The ILD of the exterior portion 14 in one embodiment is 5 to 30 lbs, in one embodiment 7.5 to 20 lbs and in one embodiment 10 to 18 lbs. The more dense and firm core 12 of the pillow 10 also reduces the risk of the pillow 10 collapsing under the weight of a patient. As one skilled in the art will appreciate, foams, especially open cell foams, having the foregoing range of densities and ILDs are compressible under pressure and will return to their original shape when the pressure is removed.

It has been found that the size of the pillow 10 and the density and the ILD of both the core 12 and the exterior portion 14 can be optimized for the height and weight of the patient as indicated below in TABLE 1. It is noted that the last entry in TABLE 1 is for a cervical pillow which can be used to support a patient's neck. The cervical pillow is otherwise the same as the pillow 10 of the first embodiment. Also identified in TABLE 1 is the length of a pillow 10 suitable for patients with the specified height and weight. With additional reference to FIG. 3, TABLE 1 also identifies the dimensions in terms of height H, width W, and length L of the exterior portion, and the convolution height C of the exterior portion. TABLE 1 also identifies the diameter and the length of the core for each pillow.

TABLE 1

| Patient | | Exterior Portion 14 | | | | Core 12 | | | |
|---|---|---|---|---|---|---|---|---|---|
| Height and Weight | Overall Pillow Length | Dimension H × W × L (inches) | Convolute to C (inches) | Density (lbs/cu · ft) | ILD (lbs) | Diameter (inches) | Length (inches) | Density (lbs/cu · ft) | ILD (lbs) |
| Up to 5'1" and 100 lbs | 14 | 6 × 14 × 15.5 | 0.75 | 1.1 | 14 | 1.5 | 15.5 | 1.2 | 36 |
| Up to 5'2" and 130 lbs | 18 | 7 × 16 × 21 | 1.25 | 1.1 | 14 | 2 | 21 | 1.2 | 36 |
| Up to 5'8" and 180 lbs | 21 | 7 × 16 × 25 | 1.25 | 1.1 | 14 | 2 | 25 | 1.2 | 36 |
| Up to 6'2" and 225 lbs | 26 | 7 × 16 × 21 | 1.25 | 1.1 | 14 | 2 | 27 | 1.35 | 50 |
| Up to 6'5" and 250 lbs | 28 | 7 × 16 × 21 | 1.25 | 1.1 | 14 | 2 | 31 | 2.6 | 65 |
| Cervical Pillow | 14 | 6 × 13 × 17 | 0.75 | 1.1 | 14 | 1.5 | 17 | 1.2 | 36 |

In the foregoing table it is noted that the overall pillow length for each embodiment is shorter than the length of the core 12 and the exterior portion 14. This is a result of a manufacturing step in the fabrication of the pillow 10. After the pillow 10 is fabricated as described in more detail below, the pillow 10 is cut to the length identified in the overall pillow length column.

As illustrated, the exterior portion 14 of the pillow 10 is provided with a plurality of protrusions 16, also referred to as projections, fingers or spikes. The protrusions 16 radially extend from a longitudinal axis of the pillow 10. The protrusions 16 have a generally conical or pyramid shape. A valley 18 is formed between each adjacent projection 16.

Figure 3:
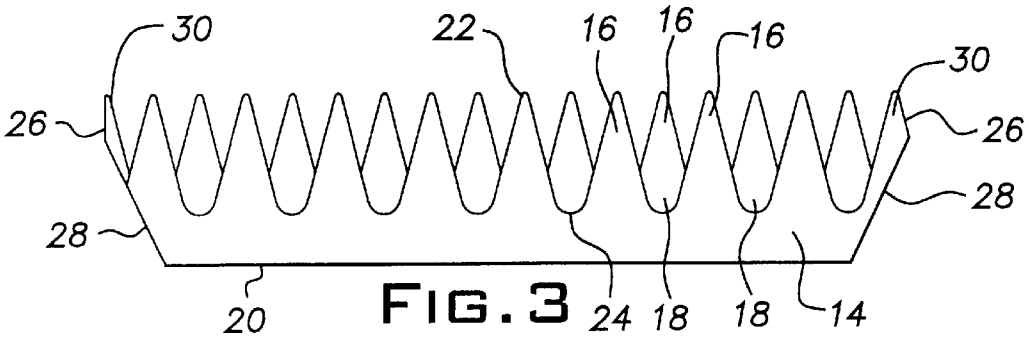
FIG. 3 is an end view of the exterior portion of the support pillow according to the first embodiment of the present invention shown in an intermediate stage of fabrication.
Figure 2:
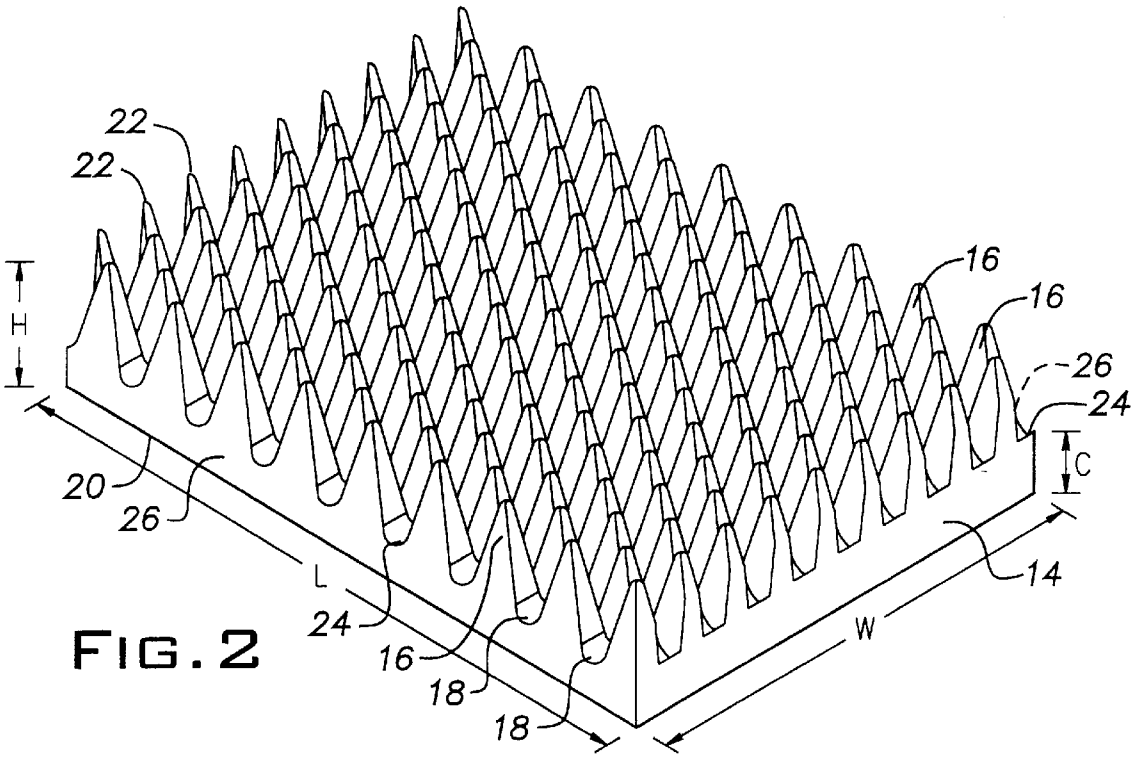
FIG. 2 is a perspective view of an exterior portion of the support pillow according to the first embodiment of the present invention shown in an intermediate stage of fabrication.

With reference to FIGS. 2 and 3, the pillow 10 is shown in intermediate stages of fabrication. As illustrated, the protrusions 16, are formed in rows. Adjacent protrusions 16 in the rows of protrusions 16 are spaced apart by 1 to 4 inches, in one embodiment 1.5 to 3 inches and in one embodiment by 2 inches. Every other row of protrusions 16 is offset from its adjacent rows so that the protrusions are formed in a "checkerboard" type arrangement. The exterior portion 14 starts as a rectangular block of foam (not shown) having height H, length L and width W. The rectangular block of foam, is then convoluted using a convoluting machine as is well known in the art. After the exterior portion 14 is convoluted it retains its basic dimensions of HxLxW but with the checkerboard arrangement of protrusions 16 as illustrated in FIG. 2. The convoluting machine convolutes the exterior portion 14 so that the projections 16 have a height measured from tips 22 of the protrusions 16 to bottoms 24 of the valleys 18 equal to the height H minus the convolution height C. Convolution height C is measured from a base 20 of the exterior portion 14 to the bottoms 24 of the valleys 18. The heights of all of the protrusions 16 are substantially uniform with respect to one another over the entire surface of the pillow 10. It is noted that in actual implementation the height of the protrusions may be slightly shorter than the height H minus the convolution height C due to some permanent compressing of the foam of the exterior portion 14 by the convoluting machine. As will become more apparent below, the protrusions 16 should have a minimum height of 3.5 inches measured from the bottoms 24 of the valleys 18 to the tips 22 of the protrusions 16 to provide pressure relief to the patient's soft tissue. In one embodiment the height of the protrusions is 3.5 to 8 inches, in one embodiment the height of the protrusions is 4 to 7 inches, and in one embodiment the height of the protrusions is 5 to 6 inches.

Referring to FIG. 3, the exterior portion 14 is shown in a subsequent stage of fabrication. After the exterior portion 14 is convoluted as illustrated in FIG. 2, lengthwise edges 26 of the exterior portion 14 are beveled to form beveled edges 28 as illustrated in FIG. 3. Remaining partial protrusions 30 are optionally removed by cutting. Next, a layer of adhesive is deposited on the exterior cylindrical surface of the core 12 and/or on the base 20 and on the beveled edges 28 of the exterior portion 14. The exterior portion 14 is then wrapped around the core 12 so that the base 20 is secured with the adhesive to the exterior cylindrical portion of the core 12 and so that the beveled edges 28 are secured to each other in a flush manner. This results in the exterior portion 14 being wrapped completely around the circumference of the core 12 as best illustrated in FIG. 1. A seam 32 will be present where the beveled edges 28 meet each other. As is apparent from FIG. 1, the pillow 10 is generally cylindrical. It is noted that in actual implementation, the end rows of protrusions 16 tend to bend inward about 30° to 45°. This is a result of a tendency of cut edges of foam to be drawn inward by tension.

Figure 4:
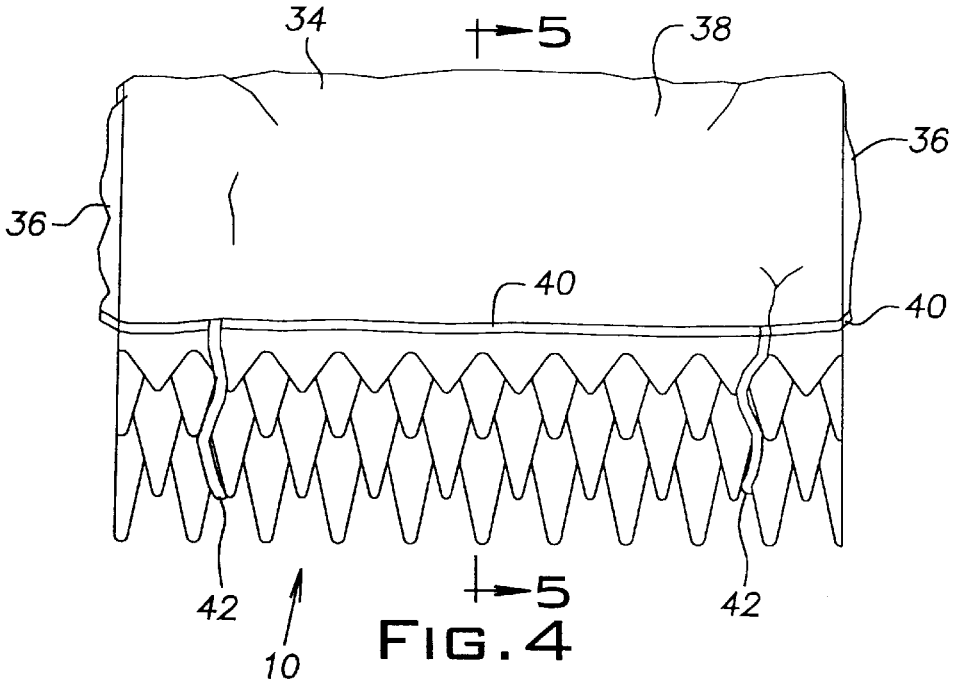
FIG. 4 is a front view of the support pillow according to the first embodiment of the present invention having a cover according to another aspect of the present invention.

Referring to FIG. 4, the pillow 10 is provided with a fabric cover 34. The fabric cover assists in keeping the pillow 10 clean and dry. For example, the cover resists moisture from liquids such as spilled beverages, perspiration, urine and blood. The cover 34 covers approximately one-half of the pillow 10 as illustrated in FIG. 4. This is so that the uncovered portion of the pillow may be placed against the bedding of the patient's bed so that the texture of the surface of the pillow will help minimize movement of the pillow relative to the patient and the bed. The covered half of the pillow is intended to be directed towards the patient and assist in keeping the pillow 10 clean and dry.

Figure 5:
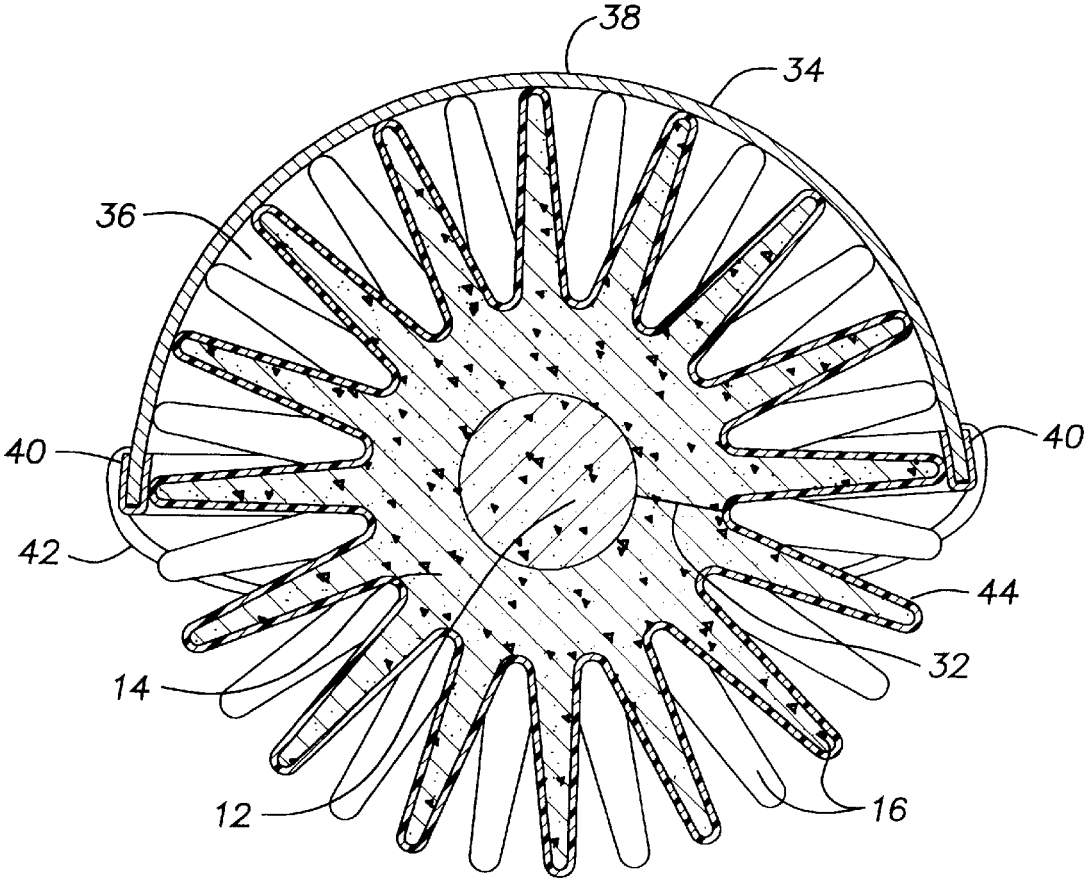
FIG. 5 is a cross section taken along the line 5—5 in FIG. 4.

The cover 34 is provided with a pair of semi-circular ends 36 and an initially rectangular piece 38. Ends of the rectangular piece 38 are stitched, using known sewing techniques, to the arcuate edges of the ends 36, thereby forming a semi-cylindrical cover 34 adapted to receive the pillow 10 as best illustrated in FIGS. 4 and 5. A strip, or strips, of reinforcing material 40 is wrapped around any exposed edges of the cover 34 and stitched in place using known sewing techniques. The strip of reinforcing material 40 prevents fraying of the fabric material used for the ends 36 and the initially rectangular piece 38. The strip of reinforcing material 40 can have a soft, felt-like texture to provide comfort to the patient. Alternatively, the reinforcing material 40 can be elastic to help retain the cover 34 on the pillow 10. The cover 34 is provided with at least two straps 42. The straps 42 assist in retaining the cover 34 on the pillow 10. Ends of the straps 42 are stitched to edges of the cover 34 a few inches from the ends 36. When the pillow 10 is inserted into the cover, the straps 42 are positioned between protrusions 16 so that the straps 42 and the protrusions 16 cooperate to secure the cover 34 in place. Since the protrusions 16 are flexible and will yield under pressure, the straps 24 are easily positioned by pressing and moving the protrusions 16 into place. As indicated above, the cover 34 allows a portion of the pillow to directly contact the patient's bed. The straps 42 also allow exposure of the protrusions 16 so that the protrusions 16 grip the bed.

The cover 34 is made of a stretch knit material such as a 100% polyester woven circular knit interlock fabric. The fabric is laminated with a one mil polyurethane film which is impermeable to sub-micron sized particles (i.e., dust mites, cat and dog dander, fungi, bacteria, etc.). The laminated film is water resistant and will stretch to conform to the stretch patterns of the fabric that it is applied to. The film helps to minimize or prevent perspiration, blood, urine, and other liquids from permeating the cover 34 and/or the pillow 10 and damaging either one. Tests on the fabric of the cover with a polyurethane film as described above indicate that the cover 34 is substantially impervious to water, bacteria, viruses and dust mite allergens.

Referring to FIG. 5 the pillow 10 is optionally provided with a layer of vinyl 44 on the external surfaces of the pillow 10. The layer of vinyl 44 is applied using a spraying technique as is known in the art. Alternatively, the layer of vinyl 44 can be applied by dipping the pillow 10 into a liquid vinyl bath. In one embodiment, the layer of vinyl 44 is 0.05 mm to 1.0 mm thick. The layer of vinyl is thin enough to flex and move with the movement and compression of the foam components 12, 14 of the pillow 10. The vinyl coating 44 protects the pillow from contaminants, such as liquids, bacteria, viruses and dust mites, and allows the pillow 10 to be disinfected. The layer of vinyl 44 also helps to reduce cutting and tearing of the pillow 10.

As discussed above, the pillow 10 is provided with a core 12 which is more dense than the exterior portion 14. In addition, the exterior portion is provided with protrusions 16. It has been found that the configuration of protrusions 16 described above and the differing foam density and firmness of the core 12 and exterior portion 14 will adequately support the patient while reducing pressure placed on the patient's soft tissue caused by compression of the soft tissue by bony prominents. The pillow 10 provides enough pressure relief on the soft tissue to reduce the risk of the patient developing pressure ulcers and may also help heal existing pressure ulcers. Without this pressure reduction, the patient may experience tissue breakdown resulting in pressure ulcers, especially if the patient is bed ridden or forced to remain in lying positions for extended periods of time. It has been found that the spacing and height of the protrusions identified above provides enough support to the patient so he or she may be comfortably supported on their side, allows the pressure reduction as described above and allows sufficient blood flow volume to flow through the soft tissue of the patient in the area adjacent to pillow 10.

As discussed above, the configuration of the pillow resists movement of the pillow with respect to the bed. This is in part due to the fact that the protrusions 16 tend to grab and hold against the bedding such as sheets, blankets, mattress pads and the like. In addition, a more dense core provides increased stiffness to the pillow 10 than if the pillow had been made solely out of the foam used for the exterior portion 14. The combination of the enhanced stiffness of the core 12 and the protrusions 16 interacting with the bed will help keep the pillow 10 in position and substantially prevent the patient from being able to roll onto his or her back.

Figure 6:
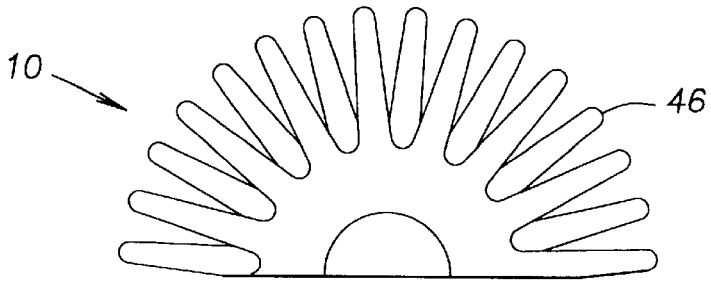
FIG. 6 is a an end view of the support pillow according to the first embodiment of the invention cut in half along a longitudinal axis.

FIG. 6 shows a pillow 1 0 which has been cut lengthwise in half along a longitudinal axis of the pillow 10. The foam used in both the core 12 and the exterior portion 14 can be cut using known techniques, such as wire cutting or with a serrated blade. Therefore, the pillow 10, after it has been constructed as illustrated in FIG. 1, can also be cut using known foam cutting techniques. The resulting semi-cylindrical pillow illustrated in FIG. 6 can be used for various forms of patient positioning such as lumbar support, spinal support, neck or head support and leg support. It is noted that any of the pillows discussed herein have application outside of use with a bed ridden patient. Example alternative uses include use when sitting on a sofa or chair, reading in bed and traveling in a car or airplane.

Figure 7:
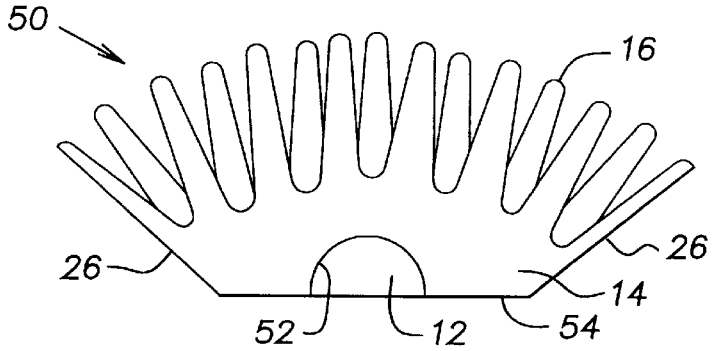
FIG. 7 is an end view of a support pillow according to a second embodiment of the present invention.

Referring to FIG. 7, a second embodiment of the present invention is illustrated. The second embodiment provides a pillow 50 for use with a patient who is at risk for the development of arterial ulcers or who has already developed arterial ulcers. Arterial ulcers are caused by insufficient arterial perfusion to an extremity or location on a patient's body and are also commonly referred to as ischemic ulcers. Ischemic ulcers denote a skin lesion with tissue loss related to arterial disease and is typically not used to describe an actual profusion state of the ulcer. Although arterial insufficiency may affect any portion of a patient's body it usually involves the lower extremities. The pillow 50 aids in relieving or reducing pressure by spreading support over the patient's body to minimize ischemic pressure to help relieve or prevent arterial ulcers form forming. The pillow 50 is not intended to elevate the patient's legs, but does provide lift to the patient's heels to support bony prominents found in the patient's heel area. Similar to the pillow 10, the pillow 50 has protrusions 16 to offer conforming support to the patient's lower legs, heels and ankles while allowing blood circulation through these areas. The pillow 50 slightly lifts the patient's heels, but not high enough so as to compromise arterial hydraulic pressure.

The pillow 50 has a semi-cylindrical core 12 made from open cell polyurethane foam having a density in one embodiment of 0.5 to 5 lbs/cu·ft, in one embodiment 0.75 to 2 lbs/cu·ft and in one embodiment 1.25 to 1.35 lbs/cu·ft and an ILD in one embodiment of 15 to 100 lbs, in one embodiment of 30 to 70 lbs, in one embodiment of 45 to 55 lbs and in one embodiment 50–52 lbs. As used herein, the term semi-cylindrical is approximately one half of a cylinder cut along a longitudinal axis. However, one skilled in the art will recognize that the pillow 50 can also be made with a core 12 which is less than or greater than semi-cylindrical. The pillow 50 has an exterior portion 14 made from open cell polyurethane foam having density in one embodiment of 0.25 to 5.0 lbs/cu·ft, in one embodiment 0.75 to 1.5 lbs/cu·ft and in one embodiment 0.9 to 1.0 lbs/cu·ft and a ILD in one embodiment of 5 to 30 lbs, in one embodiment 8 to 20 lbs and in one embodiment 12–16 lbs. The more dense and firm core 12 of the pillow 50 also reduces the risk of the pillow 50 collapsing under the weight of a patient.

The exterior portion 14 is provided with protrusions 26 as found on the pillow 10. However, the protrusions extend generally upward and are "fanned-out" to form a "crown-like" arrangement when viewed from the end of the pillow 10 as illustrated in FIG. 7. In this arrangement, the protrusions 16 in the center of the pillow extend radially from the center of the core 12 but the protrusions 16 on the sides of the pillow extend so that a longitudinal axis of the protrusions 16 will be approximately tangential to the circumference of the core 12. Alternatively, all of the protrusions 16 can extend radially from a center of the core 12. In another embodiment, the tips of the protrusions 16 define an arc with a very large radius as compared to the overall height of the pillow 50.

The crown-like arrangement is partially dependent upon how the pillow 50 is fabricated. The pillow 50 is fabricated by providing a convoluted piece of exterior portion 14 foam as illustrated in FIG. 2. A semi-circular notch is then formed or cut into the base 20 of the exterior portion. The notch has a radius the same as or slightly smaller than the radius of the core 12. Adhesive is then sprayed on the arcuate portion of the core 12 and/or the arcuate portion of the notch and then the exterior portion 14 is fitted onto the core 12 so that the arcuate portion of the notch 42 receives the arcuate portion of the core 12, If the radius of the notch 52 is smaller than the radius of the core 12, then as the exterior portion 14 is mated with the core 12 the exterior portion 14 will bend slightly around the core 12 giving the protrusions 16 the crown like appearance illustrated in FIG. 7. In addition, the lengthwise edges 26 of the exterior portion 14 for the pillow 50 can be beveled to provide more of a "trapezoidal" shape between a bottom 54 of the pillow and the lengthwise edges 26 of the pillow 50. The resultant pillow 50 has a generally planar bottom 54. Planar bottom 54 helps prevent the pillow 10 from shifting, rolling or moving while in use to support a patient's legs. As with the pillow 10, all of the exterior surfaces of the pillow 50 are coated with a layer of vinyl.

The core 12 has a radius in one embodiment of 0.25 inches to 2 inches, in one embodiment of 0.5 to 1.5 inches and in one embodiment of about 1 inch. The radius of the notch 52 is similarly sized. The bottom 54 of the pillow 50 has a width in one embodiment of 8 to 12 inches and in one embodiment about 10 inches. The overall uncompressed height of the pillow 50 is preferably about 5.5 inches. In another embodiment, the overall uncompressed height of the pillow 50 is 4 to 9 inches. A convolution height C of the exterior portion 14 in one embodiment of 1 to 5 inches, in one embodiment 2 to 4 inches and in one embodiment about 3 inches. The protrusions 16 have a height (i.e., height H minus height C) in one embodiment of 1 to 5 inches, and in one embodiment 2.5 to 3 inches. If the radius of the core 12 is 1 inch, the convolution height of the exterior portion 14 is 3 inches, the density of the core 12 is 1.25 to 1.35 lbs/cu·ft, the ILD of the core 12 is 50 to 52 lbs, the density of the exterior portion 14 is 0.9 to 1.0 lbs/cu·ft and the ILD of the exterior portion 14 is 12 to 16 lbs, then the height of the protrusions 16 cannot effectively be greater than 3 inches. The pillow 50 of the second embodiment is about three feet long so that a patient's legs will not easily be dislodged from the pillow 50.

Figure 8:
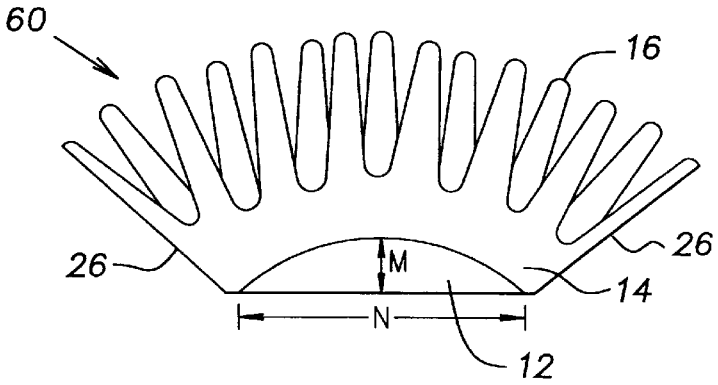
FIG. 8 is an end view of a support pillow according to a third embodiment of the present invention.

Referring to FIG. 8, a third embodiment of the present invention is illustrated. The third embodiment provides a pillow 60 to treat venous and stasis ulcers and to minimize their appearance in bed ridden patients. The pillow 60, similar to the pillows 10, 50, has a core 12 and an exterior portion 14 with protrusions 16. The protrusions 16 are arranged in a generally crown-like arrangement similar to the protrusions 16 of the pillow 50. However, the core has a crescent-like shape as illustrated in FIG. 8. The crescent shape may be formed by starting with a rectangular piece of foam and convoluting the rectangular piece into a piece of foam with an arcuate top having a large radius and a generally planar bottom. The shape of the core 12 may also be described as a portion of a cylinder having one arcuate side and a generally planar side, the arcuate side being defined by the locus of a radius where the radius is much larger than a height M of the core. The core 12 of pillow 60 can also be fabricated by starting with a cylindrical piece of foam and cutting an appropriate section from the cylindrical piece of foam. The core 12 of pillow 60 is an open cell polyurethane foam having a density in one embodiment of 0.5 to 15 lbs/cu·ft, in one embodiment 1.5 to 5 lbs/cu·ft, in one embodiment 2.5 to 3.0 lbs/cu·ft and in one embodiment about 2.7 lbs/cu·ft and a ILD in one embodiment of 30 to 200 lbs, in one embodiment 50 to 120 lbs in one embodiment 70 to 80 lbs and in one embodiment about 75 lbs. The exterior portion 14 of the pillow 60 has a density in one embodiment of 0.25 to 5.0 lbs/cu·ft, in one embodiment 0.75 to 2.5 lbs/cu·ft and in one embodiment 0.9 to 1.0 lbs/cu·ft and a ILD in one embodiment of 5 to 30 lbs, in one embodiment 8 to 20 lbs and in one embodiment 12–16 lbs.

The core 12 of the pillow 60 offers sufficient support to elevate the patient's legs while the exterior portion 14 provides the pressure relief reduction as described above. It has experimentally been found that existing venous ulcers on a patient start to heal within two weeks of using a pillow 60 of the third embodiment of the present invention. The more dense and firm core 12 of the pillow 60 also reduces the risk of the pillow 60 collapsing under the weight of a patient. As with the pillow 10, all of the exterior surfaces of the pillow 60 are coated with a layer of vinyl.

Venous leg ulcers are the most common type of lower extremity ulcers and are generally caused by the failure of valves in the venous system which leads to failure of the pedal and calf muscle pumps. Failure of the muscle pumps results in communication of high pressures from central veins to superficial veins and capillaries in the lower extremities. The result is venous hypertension which dilates the capillaries and causing fluids, including red and white blood cells, to leak into surrounding tissue. This escaped fluid causes edema and leg pain. Red blood cells which have leaked into surrounding tissue will break down and cause staining of the leg. Leaked white blood cells may become activated and contribute to tissue dysfunction. Another complication is that fibrinogen can be converted to fibrin-forming cuffs that reduce capillary function. The pillow 60 provides support to a patient's lower extremities by providing sufficient elevation of the feet and lower legs to promote good venous drainage while also providing the pressure relief reduction as described in more detail above.

The pillow 60 is made by providing an exterior portion 14 as illustrated in FIG. 2 with or without beveled lengthwise edges 26. Adhesive is sprayed onto the arcuate portion of the core 12 and/or the base 20 of the exterior portion 14 and then the exterior portion 14 is mated to the core 12 as illustrated in FIG. 8. Generally, there is no need to form a notch in the exterior portion 14 when fabricating the pillow 60. However, as the exterior portion 14 bends around the arcuate portion of the core 12, the protrusions 16 will fan out into the crown-like pattern as illustrated in FIG. 8. The planar bottom of the core 12 forms the entire bottom, or almost the entire bottom, of the pillow 60 as illustrated in FIG. 8. The core 12 has a width N in one embodiment of 6 to 15 inches, in one embodiment 8 to 10 inches and in one embodiment about 9 inches. The core 12 of pillow 60 has a height M in one embodiment of 1 to 5 inches, in one embodiment 2 to 4 inches and in one embodiment 3.25 inches. The overall uncompressed height of the pillow 60 in one embodiment is 6–10 inches and in one embodiment about 8.25 to 8.75 inches. A convolution height C of the exterior portion 14 in one embodiment of 1 to 5 inches, in one embodiment 2 to 4 inches and in one embodiment about 2.75 inches. The protrusions 16 have a height (i.e., height H minus height C) in one embodiment of 1 to 5 inches, and in one embodiment 2.5 to 3 inches. If the height M of the core 12 is 3.25 inches, the convolution height of the exterior portion 14 is 2.75 inches, the density of the core 12 is 2.7 lbs/cu·ft, the ILD of the core 12 is 75 lbs, the density of the exterior portion 14 is 0.9 to 1.0 lbs/cu·ft and the ILD of the exterior portion 14 is 12 to 16 lbs, then the height of the protrusions cannot effectively be greater than 3 inches. The pillow 60 of the second embodiment is about three feet long so that a patient's legs will not easily be dislodged from the pillow 60. The flat bottom of the pillow 60 substantially prevents the pillow 60 from rolling or moving with respect to the patient's bed.

Figure 9:
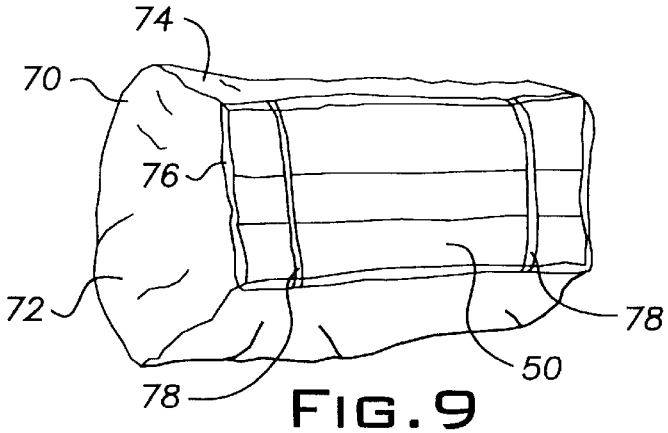
FIG. 9 is a perspective view of the support pillow according to the second embodiment of the present invention having a cover according to another aspect of the invention.

Referring to FIG. 9, the pillows 50 and 60 are also provided with a cover 70 similar to the cover 34 provided for the pillow of the first embodiment, support pillow 10. The cover 70 is made from the same coated fabric as used for the cover of 34. The cover 70 covers the protrusions 16 of either the pillow 50 or the pillow 60, but does not cover the bottom of the pillows 50, 60. Similar to the cover 34, the cover 70 has ends 72. The ends 72 have a shape which conforms to the general cross-sectional shape of the pillows 50, 60, rather than the semi-circular shape of the ends 36. The cover 70 also has a originally rectangular shaped piece 74 stitched to the ends 72. Exposed edges of the cover are wrapped with a strip of reinforcing material 76 to give the exposed edges a comfortable, tear resistant edge. Straps 78 are also provided to help keep the cover on the pillow 50 or 60. The straps 78 are similar to the straps 42 for the cover 44. The pillow 50 or 60 is inserted into the cover by compressing the pillow and pushing it into the cover 70 through an opening between the straps 78. Alternatively, the covers 34 and 70 can be secured to their respective pillows with other types of fasteners, such as a hook and loop type fastener (e.g., VELCRO).

Although particular embodiments of the invention have been described in detail, it is understood that the invention is not limited correspondingly in scope, but includes all changes, modifications and equivalents coming within the spirit and terms of the claims appended hereto.

What is claimed is:

1. A support pillow assembly for assisting to position a person on their side, comprising:

a pillow having a foam core and a foam exterior portion wrapped around the circumference of the core, the exterior portion having a plurality of projections extending radially from a longitudinal axis of the support pillow, and the core having a higher density and a higher firmness than the exterior portion; and a fabric cover, the cover being laminated and covering a semi-cylinder portion of the pillow, where the cover has straps disposed around an uncovered portion of the pillow, the straps positioned between at least a pair of adjacent protrusions.

2. The support pillow according to claim 1, wherein each projection has a height selected in the range of 3.5 to 8 inches.

3. The support pillow assembly according to claim 1, whererin the cover is laminated with a polyurethane film.

4. The support pillow assembly according to claim 1, wherein the cover is made from a polyester circular knit interlock fabric.

5. The support pillow assembly according to claim 1, wherein the pillow is coated with a layer of vinyl.

6. The support pillow assembly according to claim 1, wherein the core has a density of 1 to 3 pounds per cubic foot and a firmness measured as initial load deflection (ILD) of 30 to 70 pounds and the exterior portion has a density of 0.9 to 1.3 pound per cubic foot and an ILD of 10 to 18 pounds.

7. The support pillow assembly according to claim 1, wherein the exterior portion is initially a rectangular block of foam which has been convoluted to form the projections and lengthwise edges of the exterior portion have been beveled.

8. The support pillow assembly according to claim 1, wherein the projections are arranged in rows, adjacent rows of projections being offset from each other.

9. The support pillow assembly according to claim 8, wherein adjacent projections in the rows of projections are spaced apart 1.5 to 3 inches.

10. The support pillow assembly according to claim 1, wherein the core and the exterior portion are made from open cell polyurethane foam.

11. A support pillow assembly for supporting the lower leg extremities of a person, comprising a pillow having a semi-cylindrical foam core and a foam exterior portion, the exterior portion having a bottom defining a semi-cylindrical notch in which the core is received, the exterior portion having a top, the top defining a plurality of projections extending in a generally upward direction, and the core having a higher density and a higher firmness than the exterior portion.

12. The support pillow according to claim 11, wherein each projection has a height selected in the range of 3.5 to 8 inches.

13. The support pillow assembly according to claim 11, wherein the projections form a crown-like arrangement.

14. The support pillow assembly according to claim 11, further comprising a fabric cover, the cover being laminated with a polyurethane film, the cover covering the projections of the pillow and having an opening so that a bottom of the pillow is uncovered.

15. The support pillow assembly according to claim 14, where the cover is retained by straps around the uncovered portion of the pillow.

16. The support pillow assembly according to claim 14, wherein the cover is made from a polyester circular knit interlock fabric.

17. The support pillow assembly according to claim 11, wherein the pillow is coated with a layer of vinyl.

18. The support pillow assembly according to claim 11, wherein the core has a density of 0.75 to 2 pounds per cubic foot and a firmness measured as initial load deflection (ILD) of 30 to 70 pounds and the exterior portion has a density of 0.75 to 1.5 pound per cubic foot and an ILD of 8 to 20 pounds.

19. The support pillow assembly according to claim 11, wherein the projections are arranged in rows, adjacent rows of projections being offset from each other.

20. The support pillow assembly according to claim 19, wherein adjacent projections in the rows of projections are spaced apart 1.5 to 3 inches.

21. The support pillow assembly according to claim 11, wherein the core and the exterior portion are made from open cell polyurethane foam.

22. A support pillow assembly for supporting the lower leg extremities of a person, comprising a pillow having a foam core and a foam exterior portion, the core having a flat bottom side and an arcuate top side, the arc of the top side being defined the locus of a radius, the radius being larger than a height of the core, the exterior portion having a bottom secured to the top of the core and having a top, the top defining a plurality of projections extending in a generally upward direction, and the core having a higher density and a higher firmness than the exterior portion.

23. The support pillow according to claim 22, wherein each projection has a height selected in the range of 3.5 to 8 inches.

24. The support pillow assembly according to claim 22, wherein the projections form a crown-like arrangement.

25. The support pillow assembly according to claim 22, further comprising a fabric cover, the cover being laminated with a polyurethane film, the cover covering the projections of the pillow and having an opening so that a bottom of the pillow is uncovered.

26. The support pillow assembly according to claim 25, where the cover is retained by straps around the uncovered portion of the pillow.

27. The support pillow assembly according to claim 25, wherein the cover is made from a polyester circular knit interlock fabric.

28. The support pillow assembly according to claim 22, wherein the pillow is coated with a layer of vinyl.

29. The support pillow assembly according to claim 22, wherein the core has a density of 1.5 to 5 pounds per cubic foot and a firmness measured as initial load deflection (ILD) of 50 to 120 pounds and the exterior portion has a density of 0.75 to 1.5 pound per cubic foot and an ILD of 8 to 20 pounds.

30. The support pillow assembly according to claim 22, wherein the projections are arranged in rows, adjacent rows of projections being offset from each other.

31. The support pillow assembly according to claim 30, wherein adjacent projections in the rows of projections are spaced apart 1.5 to 3 inches.

32. The support pillow assembly according to claim 22, wherein the core and the exterior portion are made from open cell polyurethane foam.

* * * * *